US007743838B2

(12) United States Patent
Wilson

(10) Patent No.: US 7,743,838 B2
(45) Date of Patent: Jun. 29, 2010

(54) SPRINKLER HEAD SHUT OFF TOOL

(76) Inventor: Mark Wilson, 10806 Fairford Ave., Downey, CA (US) 90241

( * ) Notice: Subject to any disclaimer, the term of this patent is extended or adjusted under 35 U.S.C. 154(b) by 309 days.

(21) Appl. No.: 11/715,644

(22) Filed: Mar. 8, 2007

(65) Prior Publication Data

US 2008/0217027 A1 Sep. 11, 2008

(51) Int. Cl.
*A62C 39/00* (2006.01)

(52) U.S. Cl. ..... 169/90; 169/37; 81/126; 81/129; 251/147; 138/89

(58) Field of Classification Search ..... 169/90; 251/90, 291, 321; 81/126, 129; 138/89
See application file for complete search history.

(56) References Cited

U.S. PATENT DOCUMENTS

| | | | | | |
|---|---|---|---|---|---|
| 64,904 | A * | 5/1867 | Perry et al. | ..... | 81/13 |
| 917,928 | A * | 4/1909 | Casey | ..... | 248/354.5 |
| 1,325,507 | A * | 12/1919 | Casey | ..... | 169/90 |
| 2,234,290 | A * | 3/1941 | Tessier | ..... | 169/90 |
| 2,700,423 | A | 1/1955 | Burkert | | |
| 3,191,685 | A | 6/1965 | Warne | | |
| 3,976,141 | A | 8/1976 | Harrington | | |
| 4,191,257 | A | 3/1980 | Mohler | | |
| 4,638,866 | A | 1/1987 | Capasso et al. | | |
| 4,830,118 | A | 5/1989 | Capasso | | |
| 4,848,661 | A | 7/1989 | Palmer et al. | | |
| 5,033,338 | A * | 7/1991 | Ford, Jr. | ..... | 81/318 |
| 6,014,917 | A * | 1/2000 | Bally et al. | ..... | 81/355 |
| 6,178,982 | B1 | 1/2001 | Longstreth | | |
| 6,499,678 | B1 | 12/2002 | Hope | | |
| 2006/0042803 | A1 | 3/2006 | Gallaher | | |

* cited by examiner

*Primary Examiner*—Dinh Q Nguyen
(74) *Attorney, Agent, or Firm*—Edwin Tarver; Lauson & Tarver LLP

(57) ABSTRACT

A sprinkler head shut off device, comprising of a handle with at least one jaw, a lever, a stopper arm, and a means for reciprocating the stopper arm as the lever is rotated, in order to bring a portion of the stopper arm in contact with the orifice of the sprinkler and stop water flow. The device further comprises a locking means to lock the lever in position. The locking means comprises a member attached to the lever which locks its rotary motion in one direction at a particular position by engaging with a portion of the means for reciprocating the stopper arm.

9 Claims, 14 Drawing Sheets

SPRINKLER HEAD SHUT OFF TOOL

CROSS-REFERENCE TO RELATED APPLICATION

None

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The present invention relates in general to sprinkler shut off tools for stopping the flow of water from activated fire sprinkler heads, and more particularly to an improved sprinkler head shut off tool.

The sprinkler heads of the automated fire protection sprinkler systems used in buildings and ships when activated by a fire sensor or accidentally, can cause water damage to buildings and other objects in the coverage area and other areas that the water can flow to.

Frequently, it is difficult to access the water valve to stop the flow of water from the sprinkler head. Therefore, it is desirable to have the means to stop the water flow. Several devices have been developed in art. For example, U.S. Pub. No. 20060042803 to Gallaher discloses a tool to stop the flow of water through an activated fire protection sprinkler head. This tool is designed to be a heavy duty, simple to operate mechanism capable of deactivating fire preventing sprinkler heads quickly. By simply turning the outer housing of the tool, by hand or by means of an adjustable extension pole, shut-off levers of this tool will be moved apart within the bracket of the sprinkler head until co-action between the bracket and one of the levers forces the other lever, preferably one bearing a shut-off gasket, against the open water orifice in the sprinkler head, thereby preventing the flow of water through it.

U.S. Pat. No. 3,976,141 to Harrington discloses a device useful for shutting off the flow of water from the heads to minimize the damage resulting from the continuous flow of water. The device is effective to shut off the water from the sprinkler heads whether or not the heads are mounted so that the opening is located at the top or bottom or with heads having openings at the top and also openings at the bottom. The device is so constructed as to seal off either type of opening when applied to a sprinkler head.

U.S. Pat. No. 3,191,685 to Warne discloses an invention whose principal object is to provide a simple, neat and light weight tool which can be instantly applied to an open sprinkler head to rapidly, completely and safely shutoff the discharging water. Tools have been designed for this purpose, but due to the wide variety of sprinkler heads activated in different ways; for instance by heat or impact. No one tool is designed to cover these possibilities. It is therefore another object of this invention to provide in a single tool for closing any of the conventional standard sprinkler heads regardless of whether they open downwardly or upwardly, whether they are bent or broken due to impact or activated by heat and regardless of whether they are of the fixed yoke or Cain suspension varieties.

Although prior art tools serve the same purpose but they differ structurally from the present invention. They use a thread mechanism which has to be rotated to operate the tool, whereas present tool is operated by turning a lever with hand. This and other features of the present invention will become better understood with reference to the appended Summary, Description, and Claims.

SUMMARY

The present invention relates in general to the sprinkler head shut off tools and more particularly to an improved sprinkler head shut off tool. The tool mainly includes a handle with a jaw, a stopper arm which is equipped with a stopper to come directly in contact with the orifice of the sprinkler head to stop the flow of water, a lever to operate the tool and a means for reciprocating the stopper arm as the lever is rotated. The means includes a connector arm with a curved slot, which connects the lever and the stopper arm using pins. One pin connecting the lever to the connector arm moves along the slot and facilitates the transfer of lever motion to the stopper arm. The tool also includes a locking means to lock the lever in a fixed position.

FIGURES

Reference Numerals

10 . . . Shut off tool
12 . . . Handle
14 . . . Jaw
16 . . . Lever
18 . . . Stopper Arm
20 . . . Stopper
22 . . . Connector Arm
24 . . . Locking Member
26 . . . U Shaped Portion of Jaw
28 . . . Lower Portion of Jaw
30 . . . First Portion of Stopper Arm
32 . . . Second Portion of Stopper Arm

34 . . . Third Portion of Stopper Arm
36 . . . Hole
38 . . . Bottom Portion of Stopper
40 . . . Top Cylindrical Section of Head of the Stopper
42 . . . Bottom Cylindrical Section of Head of the Stopper
44 . . . Washer
46 . . . Teeth
47 . . . Curved Slot
48 . . . First Face of Locking Member
50 . . . Second Face of Locking Member
52 . . . Third Face of Locking Member
54 . . . Inclined Portion of the Second Face of Locking Member

DETAILED DESCRIPTION

Figure 1:
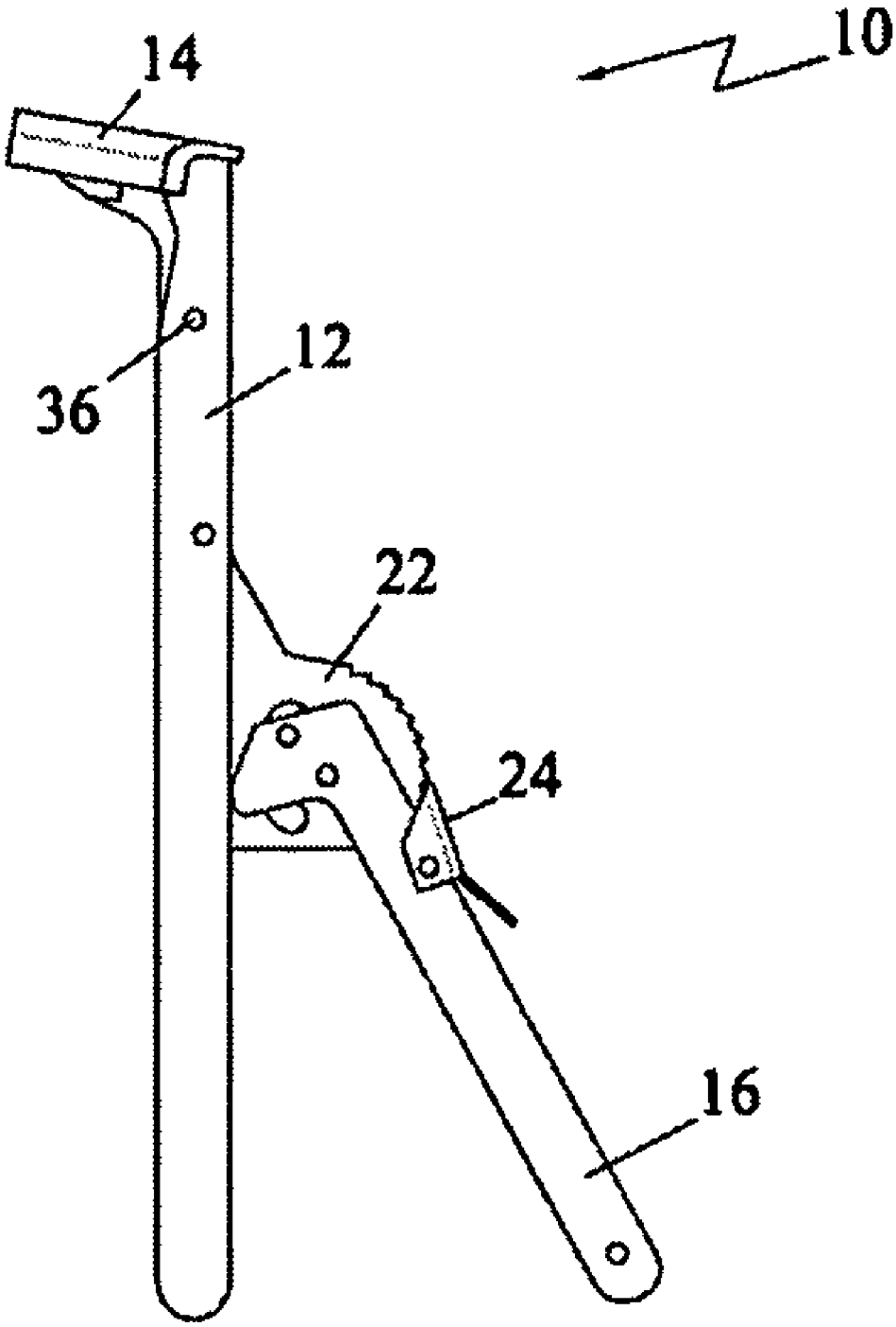
FIG. 1 is a perspective view of the sprinkler head shut off tool in accordance with the present invention.
Figure 2:
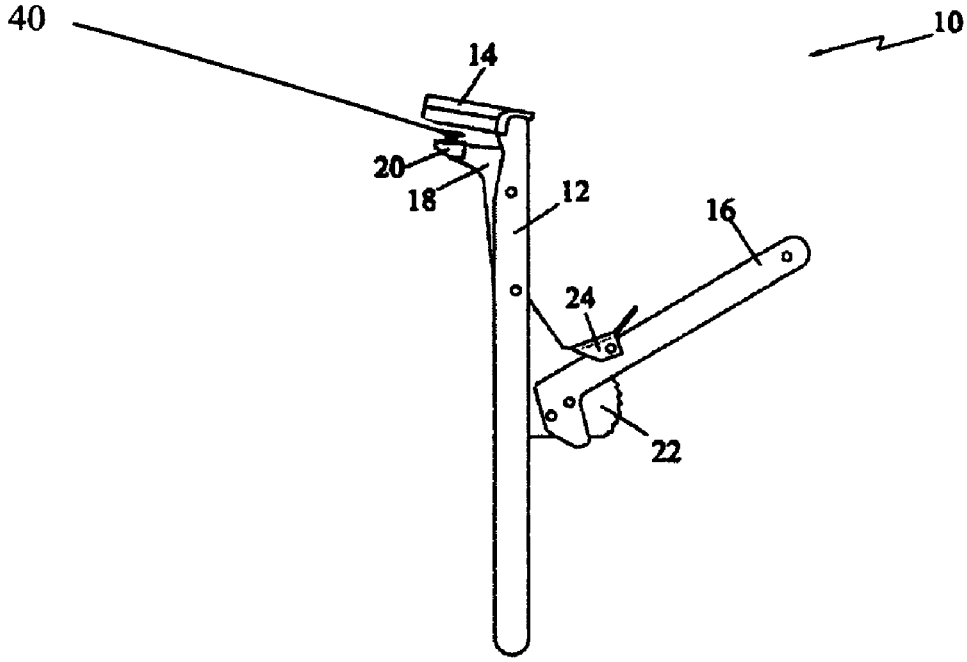
FIG. 2 is a perspective view of the sprinkler head shut off tool with the stopper and the jaw in open position.

Referring to the drawings, a preferred embodiment of the sprinkler head shut off tool is illustrated and generally indicated as 10 in FIGS. 1 and 2. The tool 10 is used to close the orifice of a fire sprinkler head to stop the flow of water from an activated sprinkler.

Referring to FIGS. 1 and 2, the tool comprises a handle 12 with a perpendicular jaw 14, a lever 16, a stopper arm 18 with a stopper 20, a connector arm 22 and a locking member 24 to lock the rotation of lever 16 in one direction and a particular position.

Figure 3:
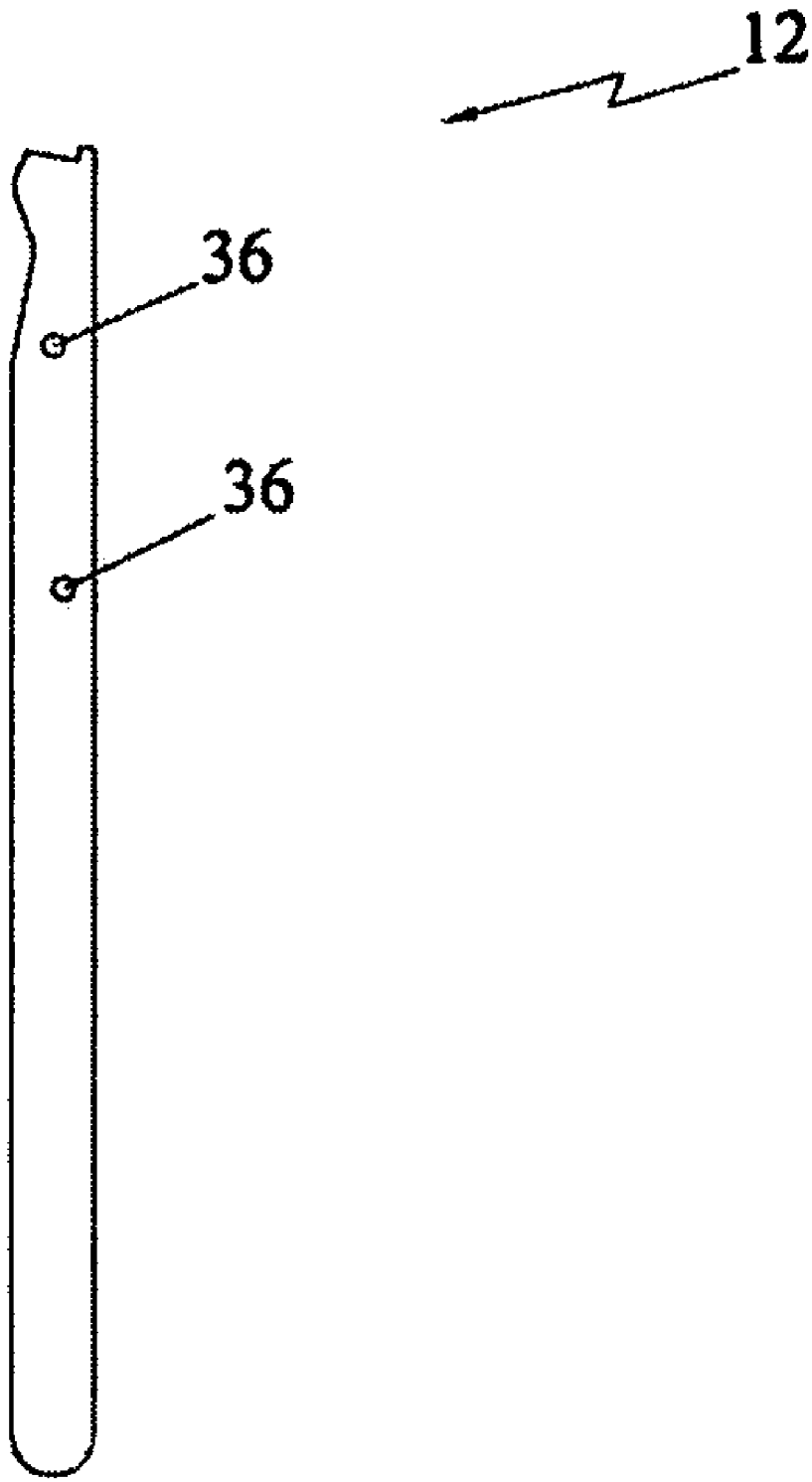
FIG. 3 is a front view of the handle.
Figure 4:
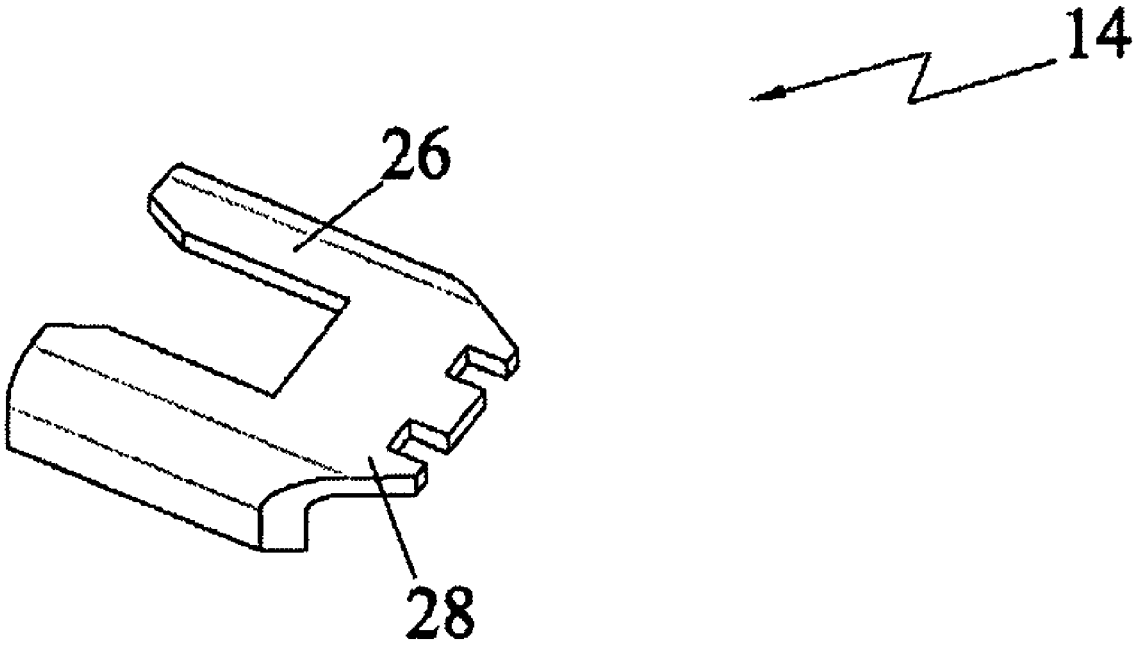
FIG. 4 is a perspective view of the jaw.
Figure 5:
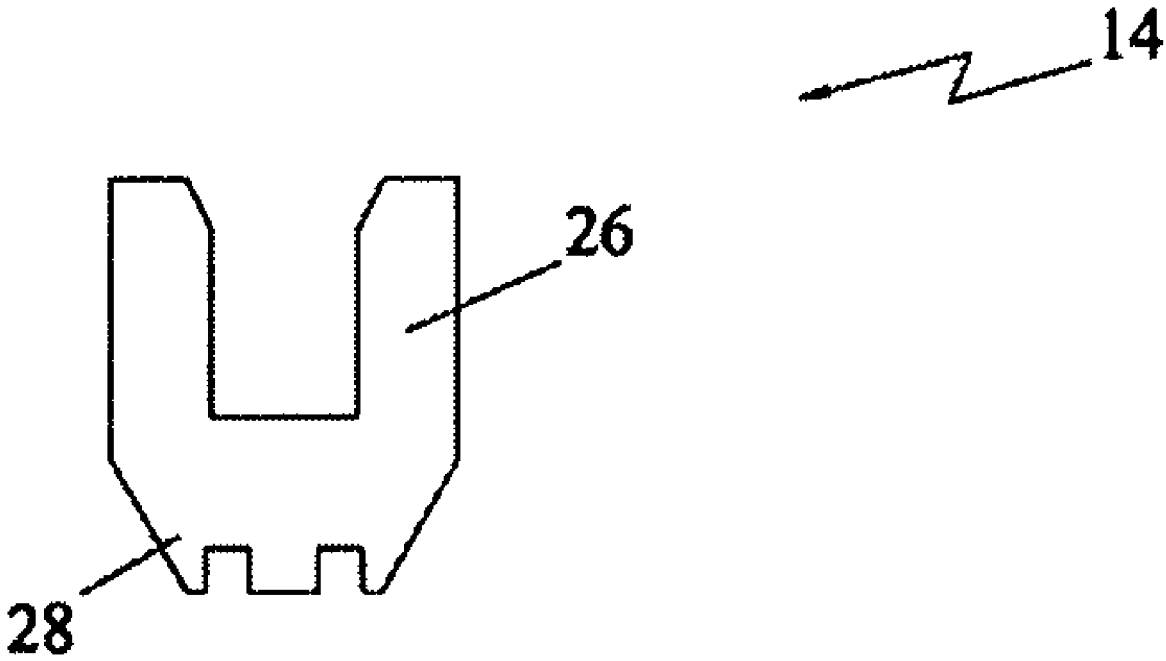
FIG. 5 is a top view of the jaw.

Referring to FIGS. 3 through 5, the handle 12 includes holes to connect it with the stopper arm 18 by pin joints. A jaw 14 is mounted perpendicularly on top of the handle 12. The jaw 14 comprises two portions, a U shaped portion 26 which is used to receive the threaded portion of the sprinkler head to engage with the sprinkler, and a bottom portion 28, to connect the jaw 14 to the handle 12. As the jaw engages with the sprinkler the stopper 20 comes near the orifice of the sprinkler head.

Figure 6:
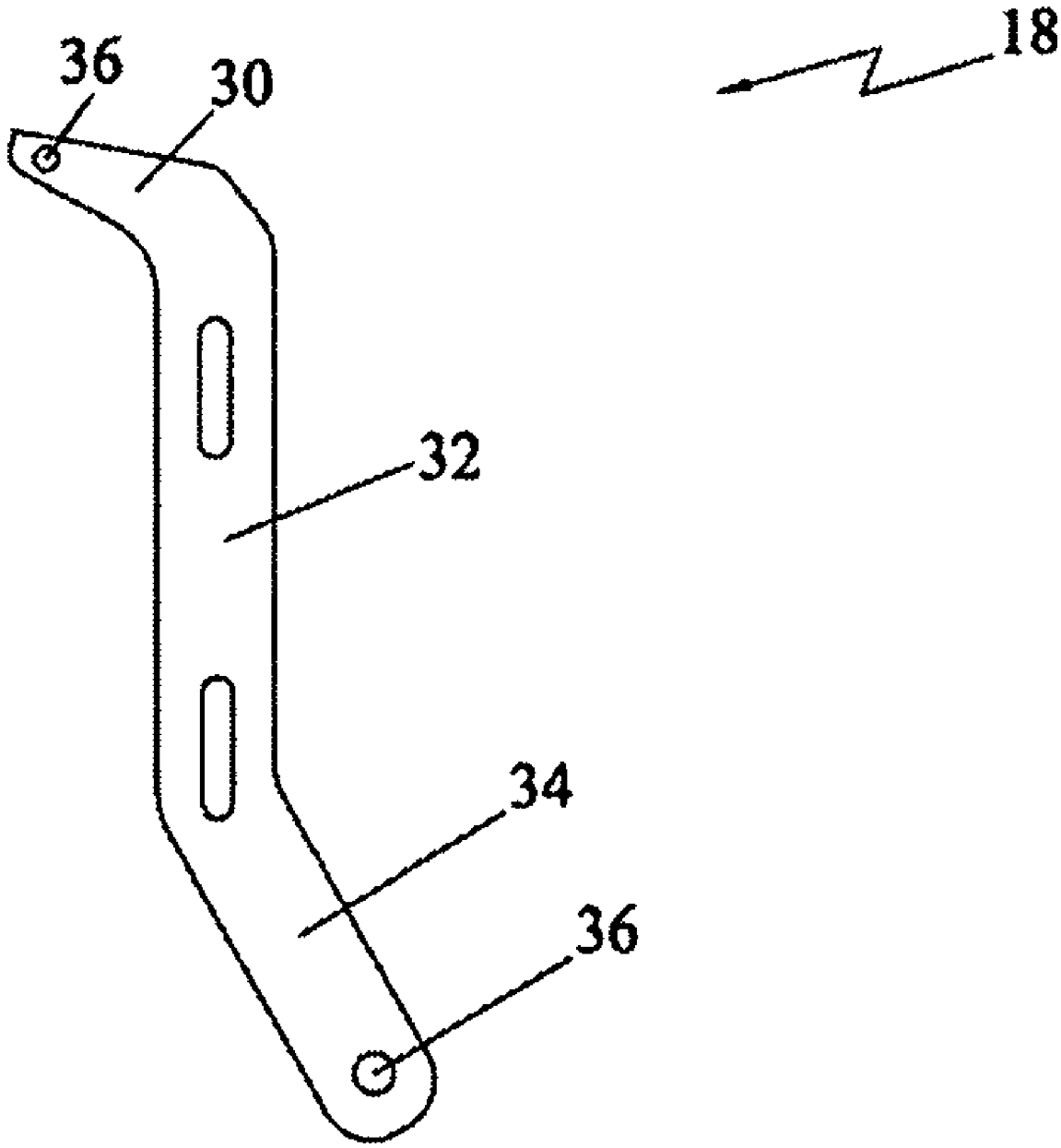
FIG. 6 is a front view of the stopper arm.
Figure 7:
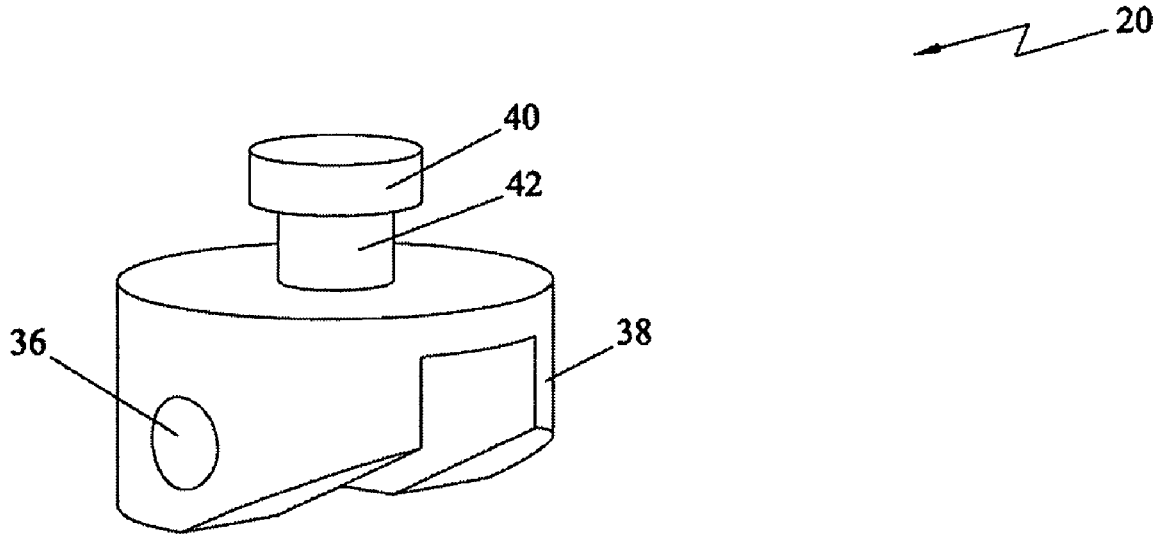
FIG. 7 is a perspective view of the stopper.
Figure 8:
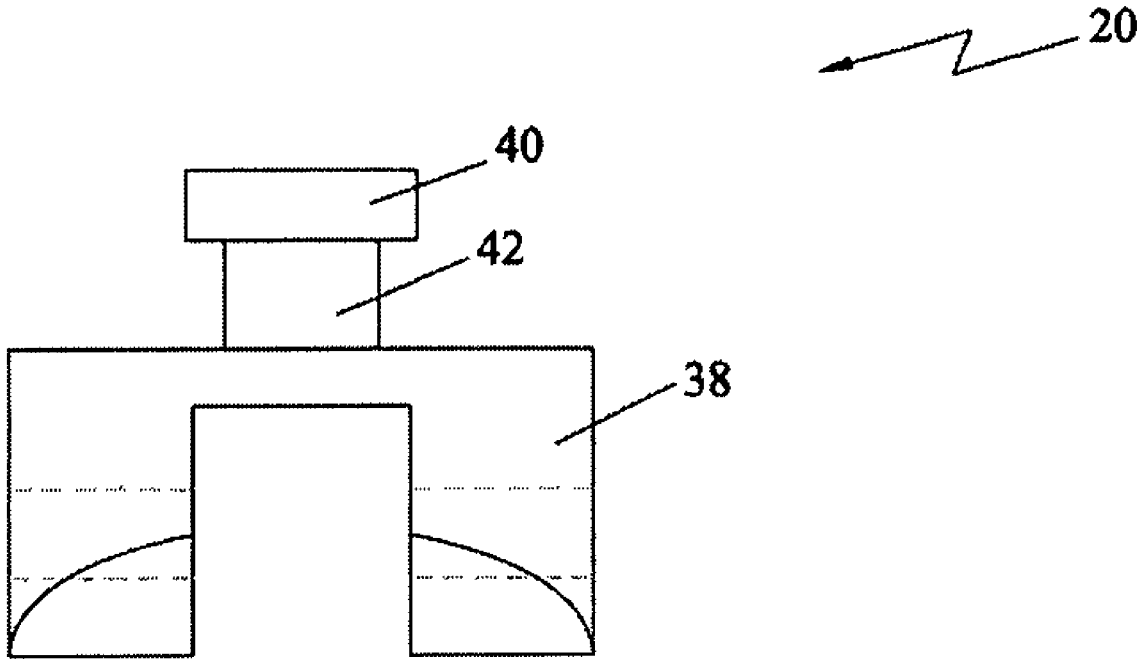
FIG. 8 is a front view of the stopper.
Figure 9:
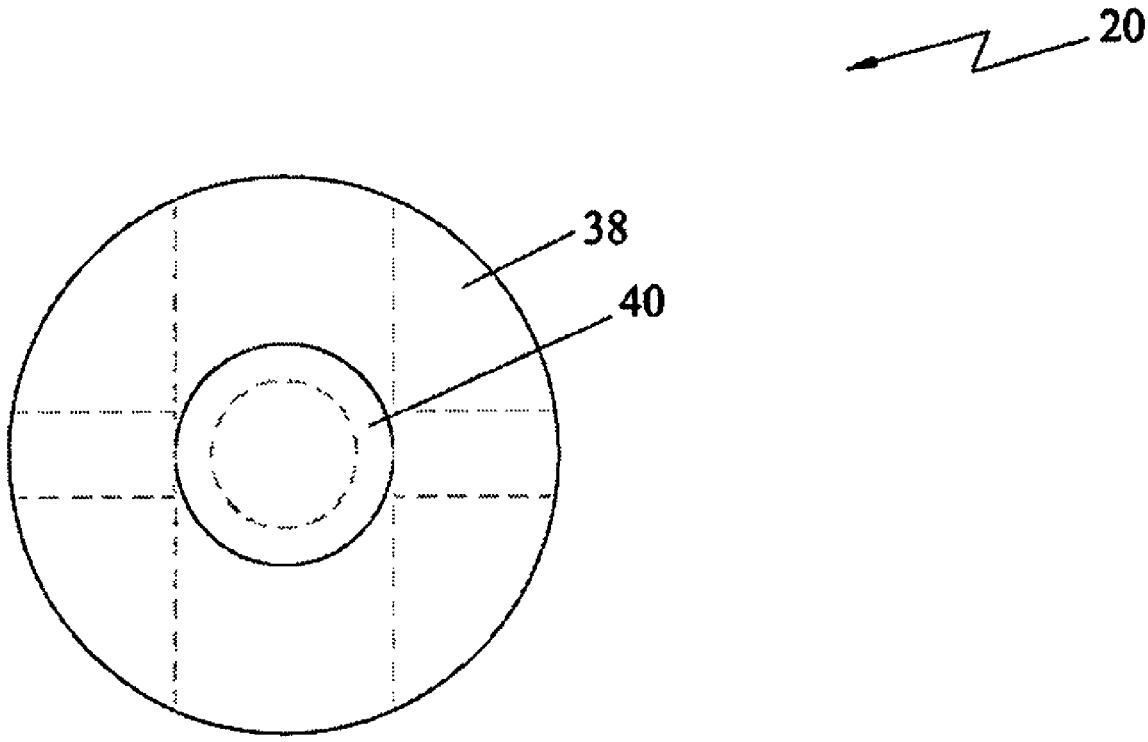
FIG. 9 is a top view of the stopper.
Figure 10:
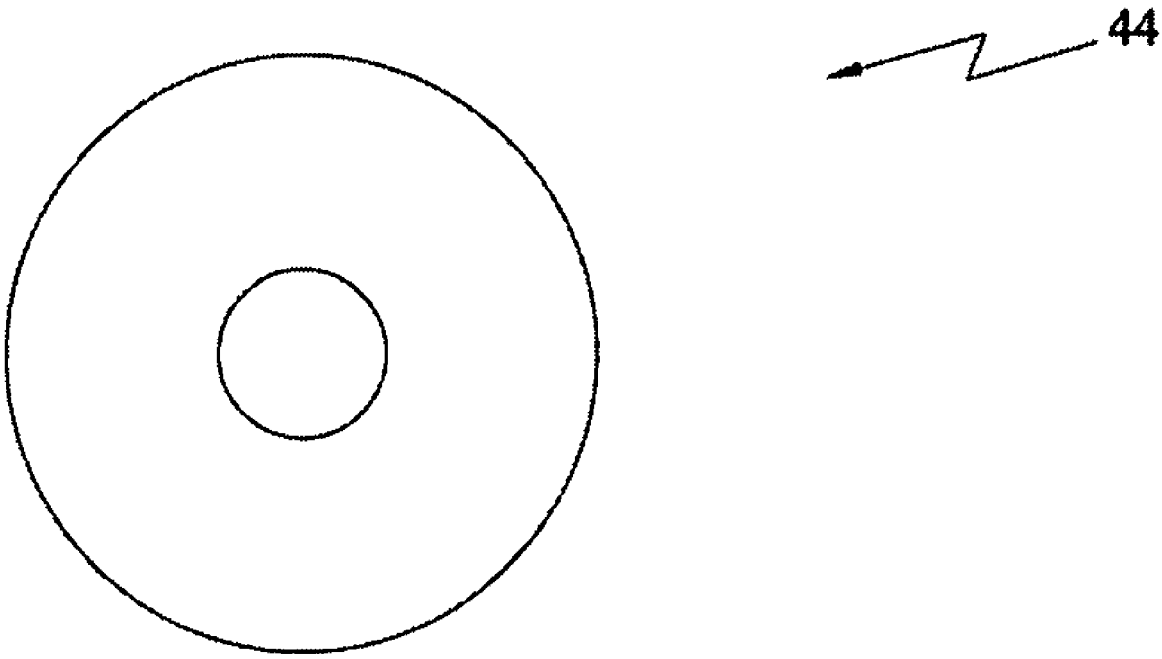
FIG. 10 is a top view of the washer.

Referring to FIG. 6, the stopper arm 18 consists of three portions namely, first 30, second 32 and third 34. The first portion 30 includes a hole to mount the stopper 20 using a pin. The second portion 32 comprises two slots to connect the stopper arm 18 with the handle 12 using pins. The pins which are fixed to the handle 12 and the slots on the stopper arm 18, guide the stopper arm 18 to reciprocate parallel to the handle 12 when a motion is induced. The second portion 32 of the stopper arm is inclined to the first portion 30 at an angle less than 180 degrees and preferably of 119 degrees. The third portion 34 is at an angle of less than 180 degrees, and preferably of 150 degrees, with the second portion 32 of the stopper arm 18. The third portion 34 also includes a hole for connecting the stopper arm 18 with the lever 16 using a pin.

Referring to FIGS. 7 through 10, the stopper 20 comprises a head portion and a bottom portion 38. The head portion includes two cylindrical sections, a top 40 and a bottom 42. The top cylindrical section 40 is made to hold the washer 44 in place. The washer 44 is made to contact the orifice of the sprinkler, while the tool 10 is used to stop the water flow. The bottom cylindrical section 42 has a diameter less than the top cylindrical section 40. A washer 44 is seated on the top of the bottom portion of the stopper 38 and held in place by the top cylindrical section of the stopper head 40 and the bottom cylindrical section of the head 42. The bottom portion of the stopper 38 comprises a cylinder with a diametrical slot and a through hole perpendicular to the slot. The slot allows mounting of the stopper 20 on the stopper arm 18 by receiving the first portion 30 of the stopper arm and inserting a pin in the through hole. The stopper 20 can also be made as part of the stopper arm 18.

Figure 11:
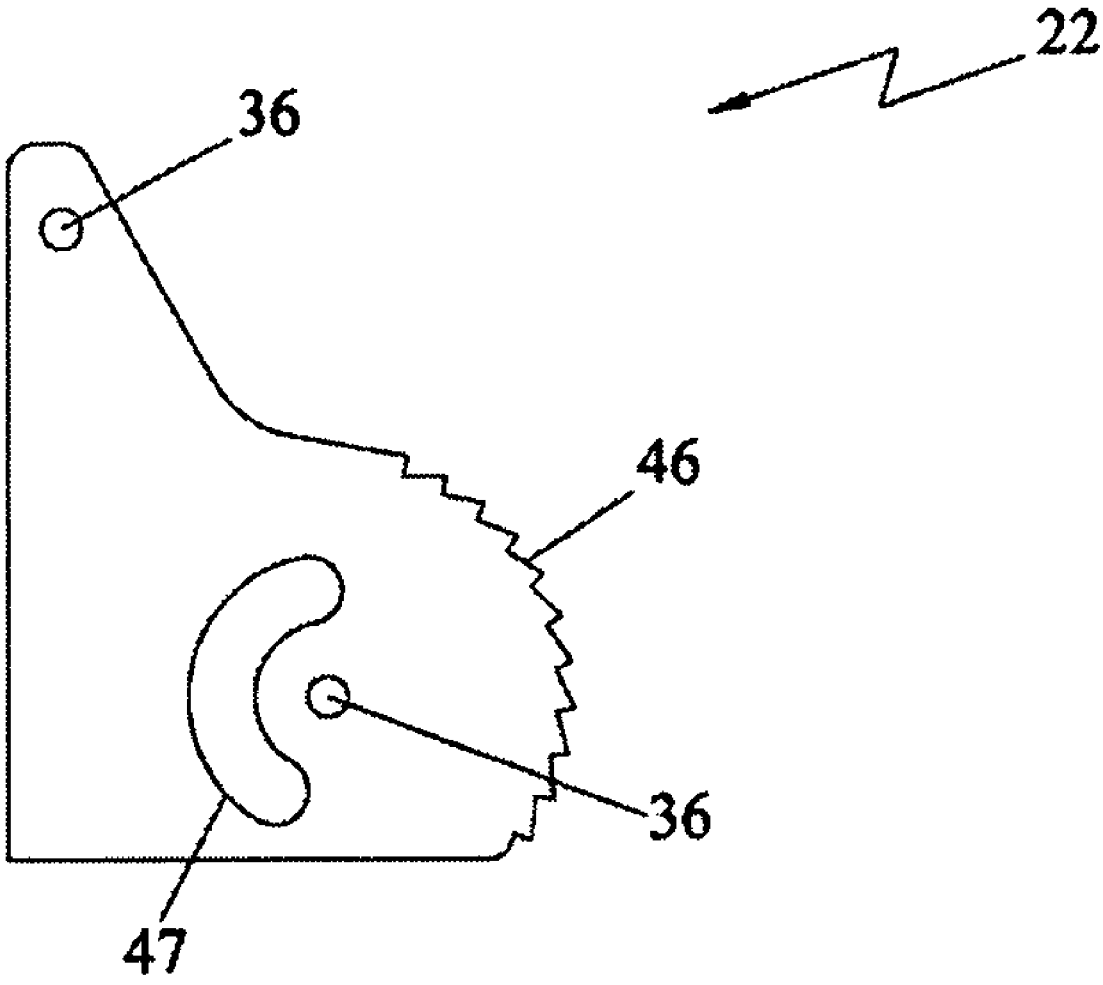
FIG. 11 is a front view of the connector arm.

Referring to FIG. 11, the connector arm 22 is a member with three straight edges and a curved edge. The curved edge has teeth 46 and forms an angle below 180 degrees at its centre. The connector arm 22 includes two holes, one for connecting it to the handle 12 and the other to the lever 16 using pin joints. The pin joint with the lever also acts as a pivot for rotating the lever 16. The connector arm 22 further comprises a curved slot 47 for facilitating a connection between the lever 16 and the stopper arm 18 using pins. The slot 47 allows the pin to move along it when the lever 16 is rotated. The pin travels freely along the slot 47 as the lever 16 is rotated. The lever 16 is connected with the stopper arm 18 and transfers its motion to the stopper arm as the lever 16 is rotated.

Figure 12:
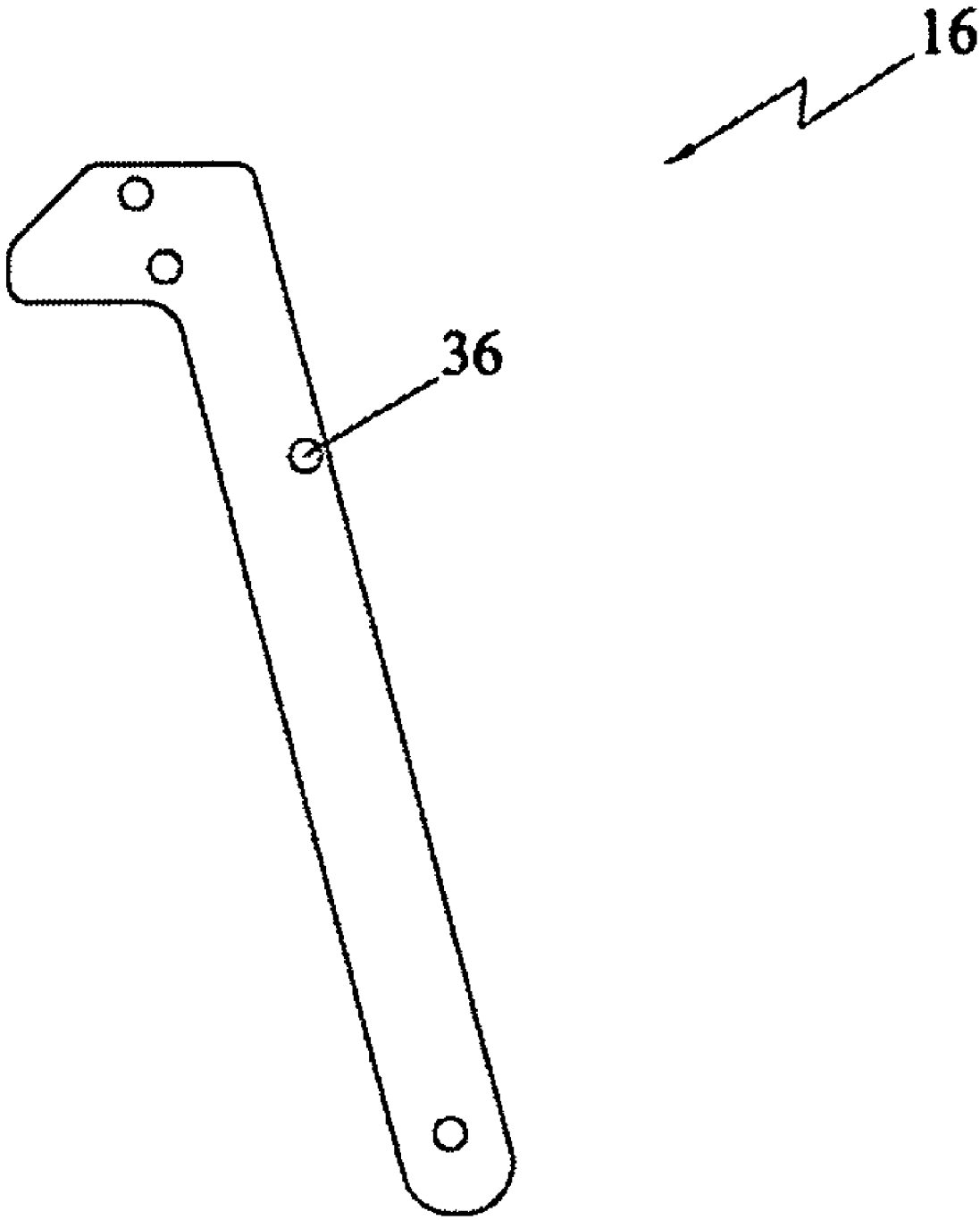
FIG. 12 is a front view of the lever.

Referring to FIG. 12, the lever 16 is a L-shaped member with holes to connect it with the connector arm 22 and the stopper arm 18 using pins, one connection serves as a pivot for rotating the lever 16 and the other is connected to the stopper arm 18 and moves freely along the curved slot 47 on the connector arm 22. As the lever 16 is rotated the pin moves along the slot 47 and moves the stopper arm 18.

Figure 13:
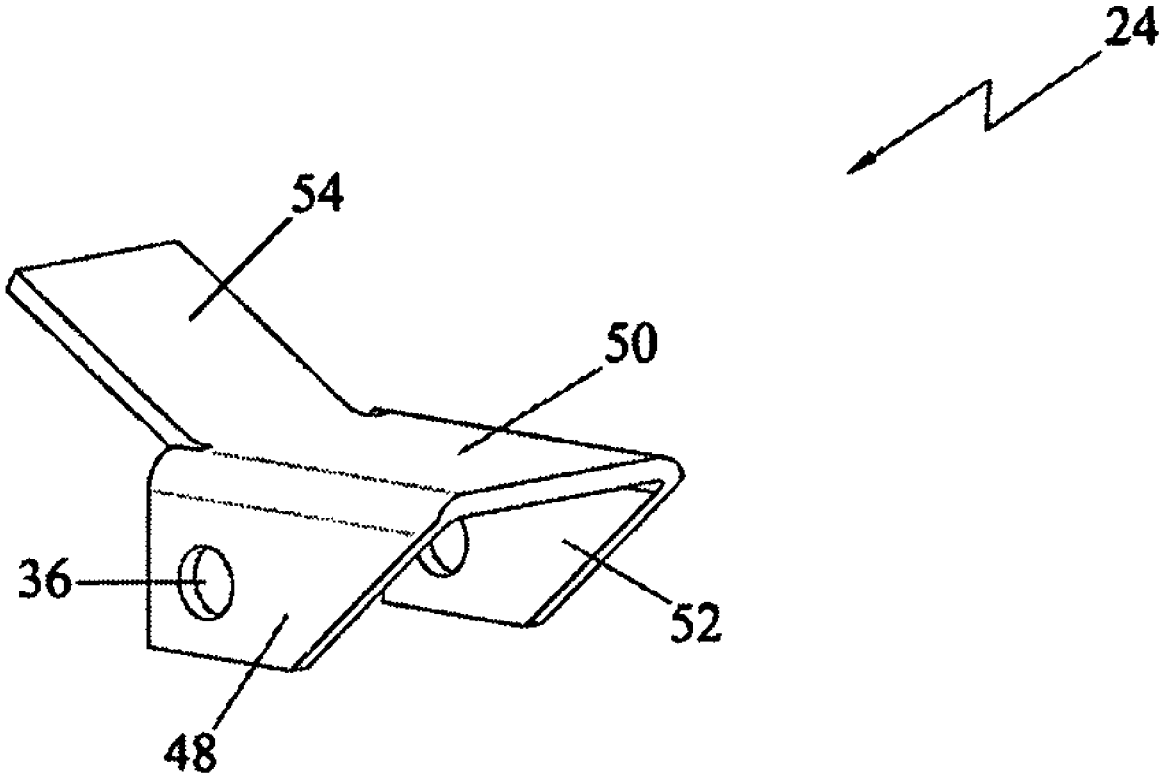
FIG. 13 is a perspective view of the locking member.
Figure 14:
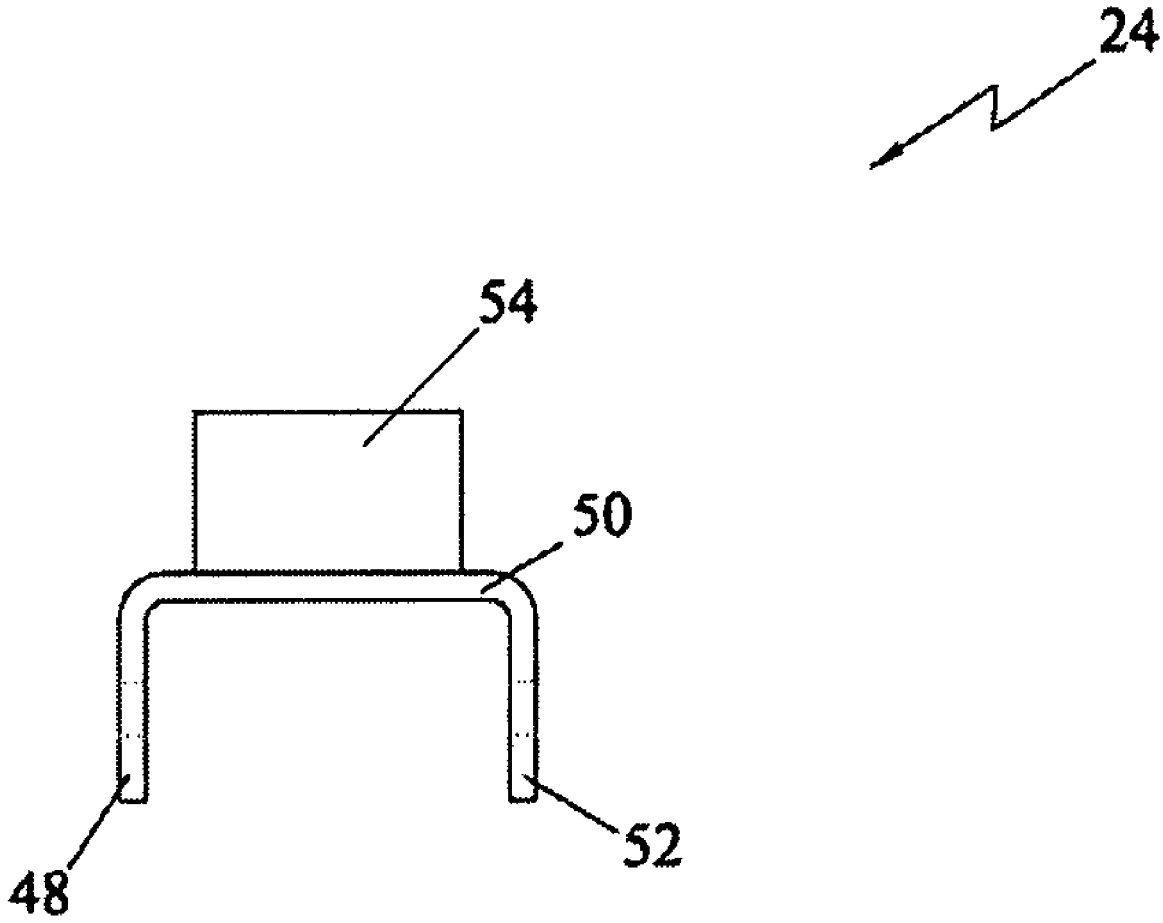
FIG. 14 is a front view of the locking member.

Referring to FIGS. 13 and 14, the lever 16 is provided with a locking member 24 to lock the lever in a particular position. The locking member is a part of a beam of channel cross section with three faces namely first face 48, second face 50 and third faces 52. The first face 48 and the third face 52 are perpendicular to the second face 50, but are parallel to each other, thus forming a gripping shape. The first 48 and third faces 52 have a through hole such that when a pin is inserted in the hole of first face 48, it can also extend to the hole of the third face 52. The second face 50 has an inclined portion 54 attached to it, at an angle below 180 degrees and preferably 150 degrees. The locking member 24 is attached to the lever 16 by a pin passing through the first 48 and third face 52 of the locking member. The inclined portion 54 of second face of the locking member is engaged with teeth on the connector arm 22 to lock the rotation of the lever 16 at a particular position. The lever can be unlocked by disengaging the inclined portion 54 of the locking member 24.

The shut off tool is operated by first unlocking the lever 16 by disengaging the locking member 24, and then rotating the lever 16 in one direction which makes the stopper arm 18 to move allowing the jaw 14 to receive the threaded portion of the sprinkler head and the stopper 20 to come near the orifice of the sprinkler head. The lever 16 can now be rotated in opposite direction to move the stopper arm 18 and then the stopper 20, thereby closing the orifice of the sprinkler head to stop the water flow.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. An improved sprinkler plug comprising:

a. a first handle comprising a handle portion and an upper jaw portion located at the top of the handle portion;

b. a second handle comprising a handle portion and a lever portion;

c. a sliding member coupled to the first handle in a manner allowing the sliding member to slide along the first handle toward and away from the upper jaw, and coupled to the second handle in an hinged manner allowing the second handle to articulate relative to the sliding member;

d. a fulcrum member adapted to be coupled to the first handle and second handle in a manner wherein when the handle portion of the second handle is lowered relative to the first handle, the sliding member is raised relative to the first handle, and wherein the fulcrum member comprises a locking mechanism for locking the second handle in place, and a guide governing the second handle's range of movement;

e. a stopper member comprising a top and a bottom, and wherein the top is adapted to form a lower jaw portion and the bottom is adapted to couple to the sliding member, so that as the sliding member moves relative to the first handle, the stopper member moves in tandem with the sliding member.

2. The device of claim 1, wherein the upper jaw portion is perpendicular to the handle.

3. The device of claim 1, wherein the fulcrum member comprises a curved slot to allow free movement of a pin connecting lever portion of the second handle to the fulcrum member.

4. The device of claim 3, wherein the fulcrum member and second handle are connected using a pin joint.

5. The device of claim 3, wherein the fulcrum member and the second handle are connected using a pint joint which acts as a pivot for rotating the lever.

6. The device of claim 1, wherein the sliding member only moves parallel to the first handle.

7. The device of claim 6, wherein the sliding member comprises at least one slot allowing the sliding member to connect to the first handle using pins that move along the slot guiding the sliding member as it moves parallel to the first handle.

8. The device of claim 1, wherein the top portion of the sliding member includes a stopper comprising a cylindrical member.

9. The device of claim 1, wherein the locking mechanism comprises a ratchet and pawl mechanism.

* * * * *